US006895869B2

(12) United States Patent
Lai

(10) Patent No.: US 6,895,869 B2
(45) Date of Patent: May 24, 2005

(54) COMPUTER DESK FOR EITHER RIGHT-HANDER OR LEFT-HANDER

(75) Inventor: Kuo-Ping Lai, Changhua (TW)

(73) Assignee: Chyi Cheng Co., Ltd., Changhua (TW)

( * ) Notice: Subject to any disclaimer, the term of this patent is extended or adjusted under 35 U.S.C. 154(b) by 82 days.

(21) Appl. No.: 10/404,862

(22) Filed: Apr. 2, 2003

(65) Prior Publication Data

US 2004/0194670 A1 Oct. 7, 2004

(51) Int. Cl.[7] ..... A47B 35/00

(52) U.S. Cl. ..... 108/50.02; 312/223.3; 108/92; 108/137

(58) Field of Search ..... 211/119.005, 119.006, 211/119.007, 162, 128.1, 126.15, 134; 312/278, 279, 280, 281, 330.1, 194, 195, 196, 223.3, 208.1; 108/50.01, 50.02, 92, 93, 101, 102, 137; 248/298.1, 918

(56) References Cited

U.S. PATENT DOCUMENTS 5,623,881 A * 4/1997 Huang ..... 108/50.01
6,220,180 B1 * 4/2001 Janowitz ..... 108/50.01
6,302,035 B1 * 10/2001 Frenkler et al. ..... 108/102
D456,170 S * 4/2002 Chang ..... D6/425
6,398,326 B1 * 6/2002 Wang ..... 312/223.3
6,619,765 B2 * 9/2003 Visser et al. ..... 312/194

* cited by examiner

*Primary Examiner*—Janet M. Wilkens
(74) *Attorney, Agent, or Firm*—Rabin & Berdo, P.C.

(57) ABSTRACT

A computer desk for either right-hander or left-hander is disclosed. The desk comprises two first crosspieces interconnected legs at both side, second and third crosspieces interconnected both sides, two links moveably mounted on the first crosspieces, a connecting member moveable along the links, a latch at the connecting member, a printer support on top of the links, a keyboard tray, a hole in each leg, and a computer platform releasably secured to the holes from one of inner and outer locations at either side of the desk. For adjusting the print support and the tray, unfasten the second crosspiece by pivoting the latch upward, slide the links along the first crosspieces and the tray along the third crosspiece to left or right side of the desk, and fasten the second crosspiece by pivoting the latch downward.

4 Claims, 4 Drawing Sheets

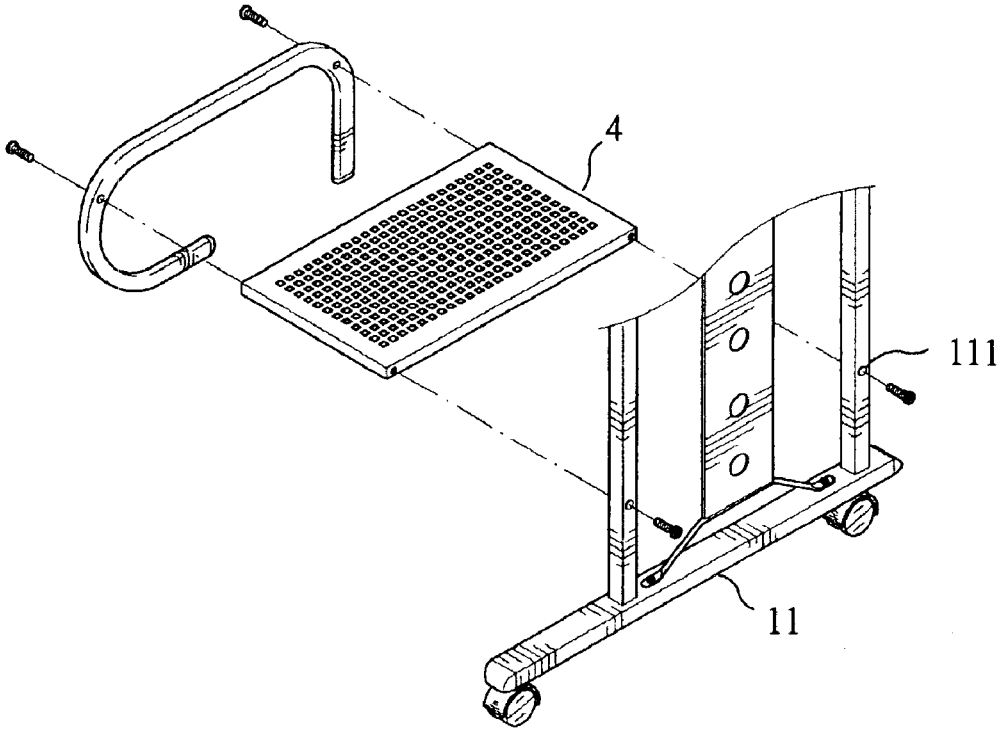
FIG.2-B
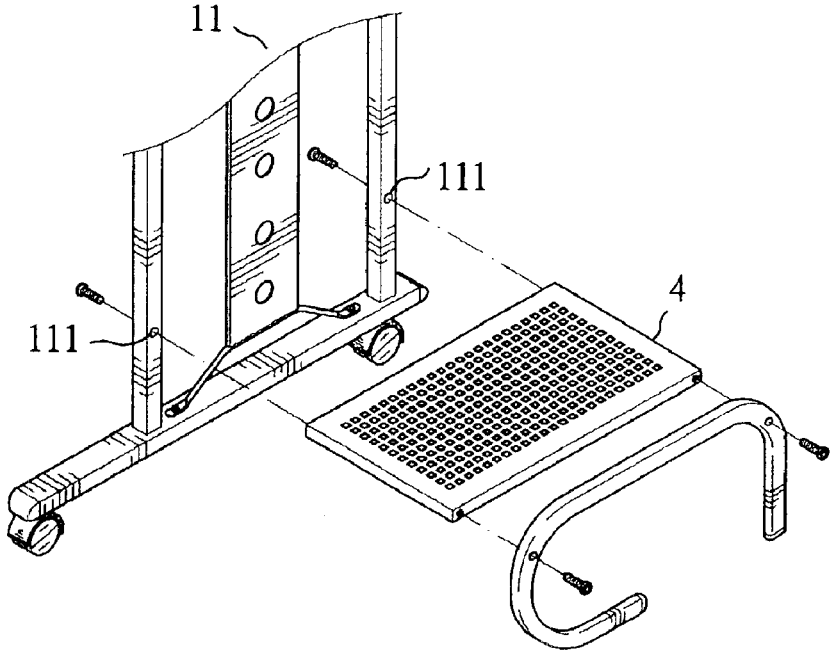
FIG.2-A

COMPUTER DESK FOR EITHER RIGHT-HANDER OR LEFT-HANDER

FIELD OF THE INVENTION

The present invention relates to computer desks and more particularly to an improved computer desk adapted to be used by either a right-hander or left-hander.

BACKGROUND OF THE INVENTION

Conventionally, a computer desk is adapted to be used by a right-hander. Inevitably, a left-hander may feel discomfort when using a computer on such desk. It is desirable among manufacturers to produce specially designed computer desks adapted to be used by left-handers. However, such computer desks have not been commercially available due to small market. Hence, a need has arisen for a computer desk which is readily adapted to be used by either a right-hander or left-hander.

SUMMARY OF THE INVENTION

It is therefore an object of the present invention to provide a computer desk adapted to be used by either a right-hander or left-hander, comprising a substantially rectangular desktop; two coupled legs at either side; two distal first crosspieces interconnected the legs at both side; an intermediate second crosspiece interconnected both sides; a proximate third crosspiece interconnected both sides; two links moveably mounted on the first crosspieces; a connecting member moveably interconnected the links; a latch at the connecting member; a printer support interconnected top sides of the links; a retractable tray for receiving a keyboard; a hole in each of the legs; and a computer platform releasably secured to the holes from one of inner and outer locations at either side of the computer desk; wherein in an adjustment of the print support and the tray, unfasten the second crosspiece by pivoting the latch in a first direction slide the links along the first crosspieces and the tray along the third crosspiece to a left or right side of the computer desk, and fasten the second crosspiece by pivoting the latch in a second direction opposite to the first direction.

The above and other objects, features and advantages of the present invention will become apparent from the following detailed description taken with the accompanying drawings.

BRIEF DESCRIPTION OF THE DRAWINGS

FIGS. 2A and 2B are exploded views illustrating possible mountings of platform in inner and outer positions at either side of the computer desk;

DETAILED DESCRIPTION OF THE PREFERRED EMBODIMENTS

Figure 1:
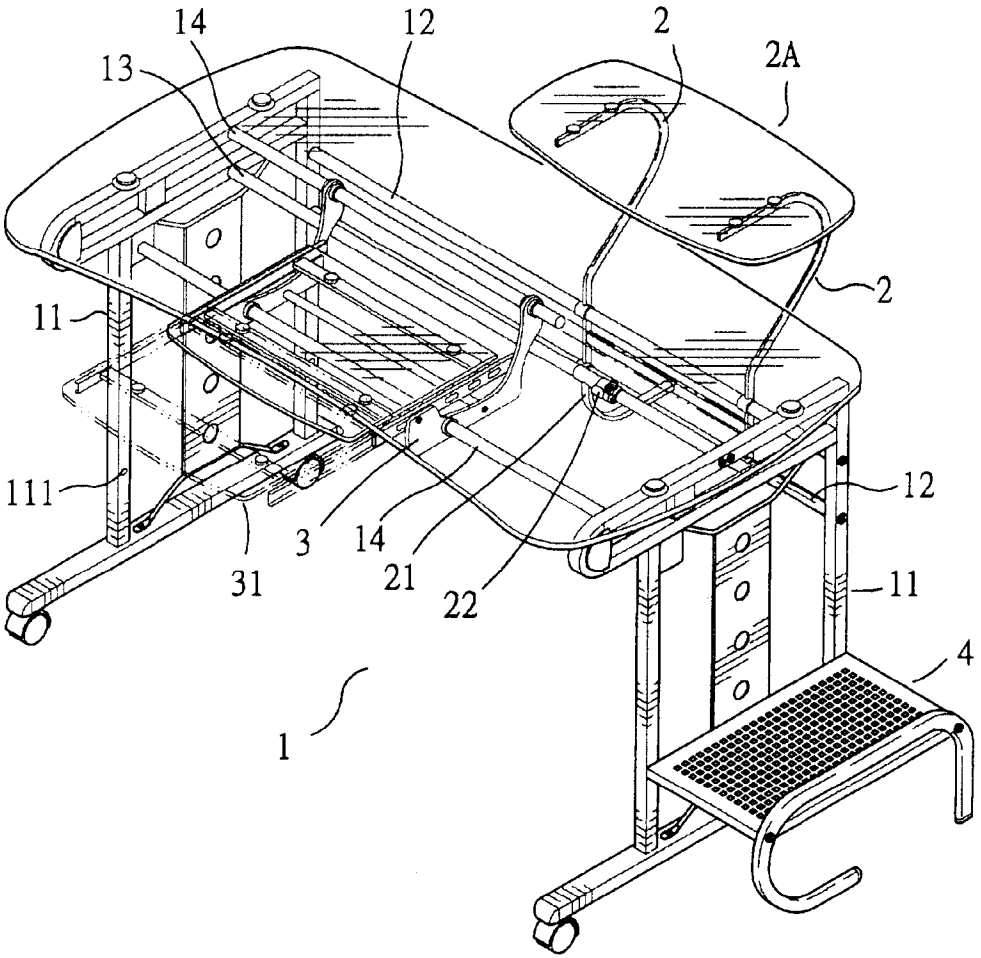
FIG. 1 is a perspective view of a preferred embodiment of computer desk according to the invention.
Figure 3:
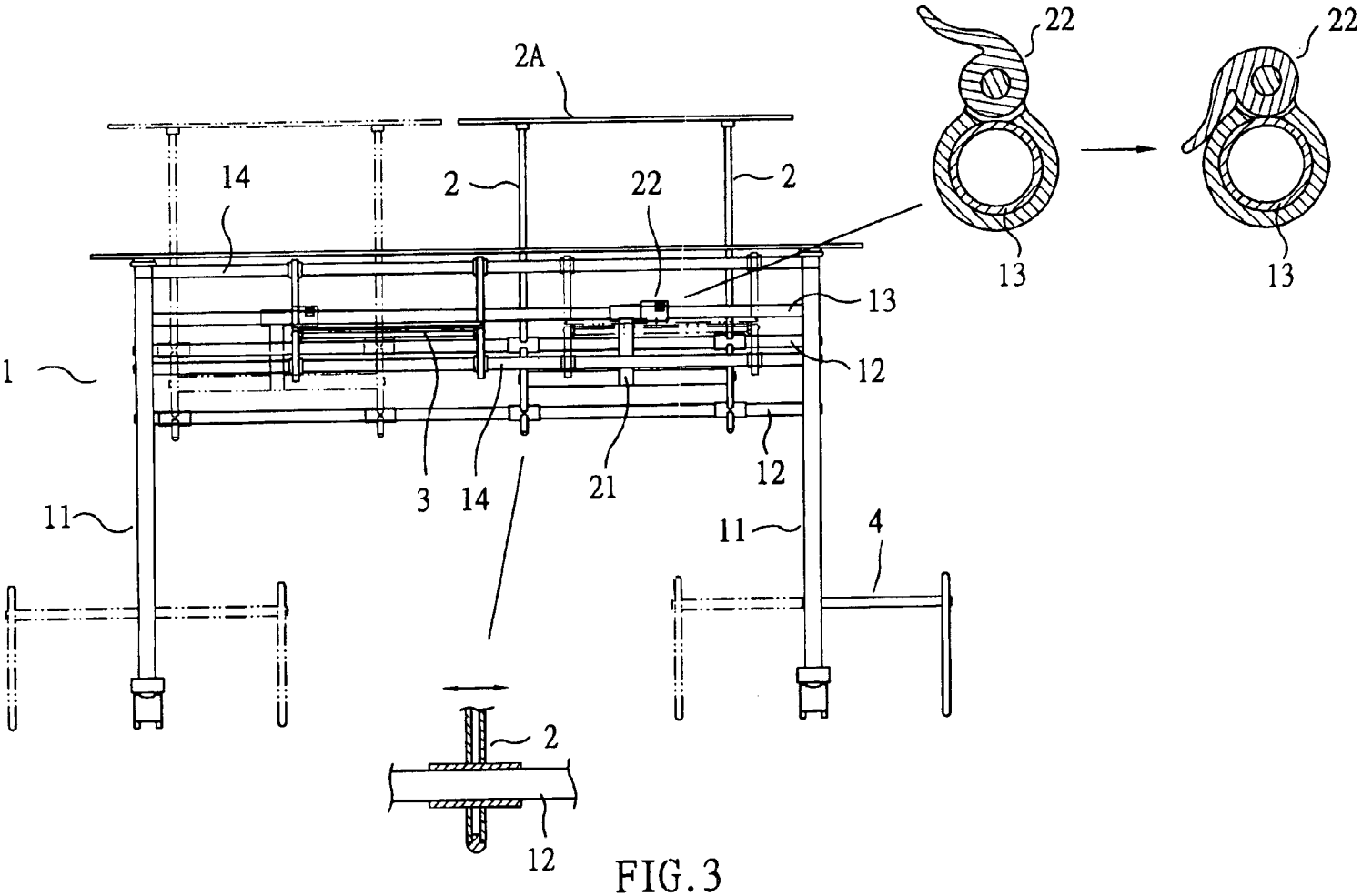
FIG. 3 is a front plan view illustrating different locations of the platform, links, and tray for being adapted to be used by either a left-hander or right-hander.

Referring to FIGS. 1 to 5, there is shown a computer desk 1 constructed in accordance with the invention. A substantially rectangular desktop of the computer desk 1 is configured to support a monitor A. The computer desk 1 further comprises two coupled legs 11 at either side, two distal first crosspieces 12 interconnecting the legs 11 at both sides, an intermediate second crosspiece 13 interconnecting both sides, a proximate third crosspiece 14 also interconnecting both sides, two spaced links 2 moveably mounted on the first crosspieces 12, a connecting member 21 moveably interconnecting the links 2, a cam lever 22 at a forward end of the connecting member 21, a support 2A interconnecting top sides of the links 2 for supporting a printer B, a frame element 3 having a retractable tray 31 mounted thereon for receiving a keyboard C so that a user can either pull the tray 31 outward for using the keyboard C or push the tray 31 inward under the desktop in a non-operating position, a hole 111 in each leg 11, and a platform 4 releasably secured to the holes 111, the platform 4 being adapted to support a computer D. The platform 4 can be mounted in each of inner and outer locations at either side of the computer desk 1 by driving fasteners (e.g., screws) through the holes 111 into the platform 4. In other words, there are four possible mounting locations of the platform 4. This is best illustrated in FIGS. 2A, 2B and 3.

Figure 5:
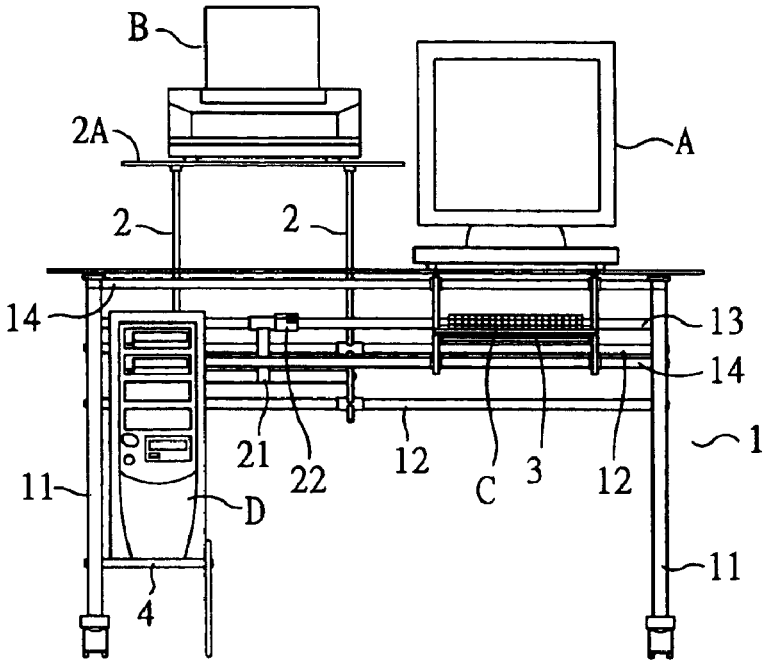
FIG. 5 is a view similar to FIG. 4 where the devices shown in FIG. 4 are mounted in changed positions for being adapted to be used by a left-hander.
Figure 4:
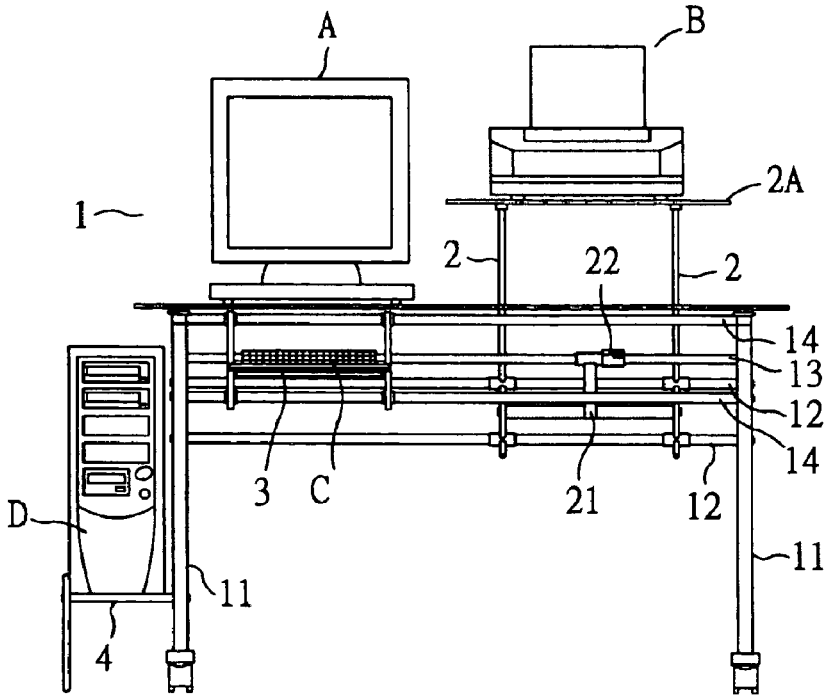
FIG. 4 is a front plan view showing the computer desk with computer, monitor, printer, and keyboard mounted in default positions for being adapted to be used by a right-hander.

For adjusting location of the support 2A and the tray 31 (see FIG. 3 ), a user must first unfasten the second crosspiece 13 by pivoting the cam lever 22 upward. Next, the links 2 are slid along the first crosspieces 12 and the tray 31 along the third crosspiece 14 to a desired left or right side of the computer desk 1. Finally, the second crosspiece 13 is fastened by pivoting the cam lever 22 downward. The computer D, monitor A, the printer B, and the keyboard C are thus mounted in the desired position for being adapted to be used by a right-hander (FIG. 4 ) or a left-hander (FIG. 5 ).

What is claimed is:

1. A computer desk adapted to be used by either a right-hander or left-hander, comprising:

a substantially rectangular desktop;

two coupled legs at either side of said desktop;

two distal first crosspieces interconnecting the legs at both sides;

an intermediate second crosspiece interconnecting the legs at both sides;

a proximate third crosspiece interconnecting the legs at both sides;

two links moveably mounted on the first crosspieces;

a connecting member moveably interconnecting the links to the second crosspiece;

a latch disposed at the connecting member;

a printer support interconnecting top sides of the links;

a retractable tray for receiving a keyboard, and being attached to the third crosspiece;

a hole in each of the legs; and a computer platform releasably secured to the holes from one of inner and outer locations at either side of the computer desk;

wherein in an adjustment of the printer support and the tray, the connecting member is unfastened from the second crosspiece by pivoting the latch in a first direction, the links are slid along the first crosspieces and the tray is slid along the third crosspiece to a left or right side of the computer desk, and the connecting member is fastened to the second crosspiece by pivoting the latch in a second direction opposite to the first direction.

2. The computer desk of claim 1, wherein the latch is a cam lever.

3. The computer desk of claim 1, wherein the first direction is an upward direction.

4. A desk, comprising:

a plurality of legs;

a plurality of first crosspieces extending between the legs of the desk;

a second crosspiece extending between the legs of the desk;

a printer support having two links which are movably mounted to the first crosspieces; and a connecting member which is mounted to the links, and movably and fastenably mounted to the second crosspiece using a latch.

* * * * *